US007888611B2

(12) United States Patent
Lin

(10) Patent No.: US 7,888,611 B2
(45) Date of Patent: Feb. 15, 2011

(54) LIMIT SWITCH CONTROL DEVICE

(75) Inventor: Tai-Hung Lin, Taichung (TW)

(73) Assignee: Hiwin Mikrosystem Corp., Taichung (TW)

( * ) Notice: Subject to any disclaimer, the term of this patent is extended or adjusted under 35 U.S.C. 154(b) by 454 days.

(21) Appl. No.: 12/164,054

(22) Filed: Jun. 29, 2008

(65) Prior Publication Data

US 2009/0321228 A1 Dec. 31, 2009

(51) Int. Cl.
*H01H 3/16* (2006.01)

(52) U.S. Cl. ..... 200/47; 307/112; 307/125

(58) Field of Classification Search ..... 200/47; 307/112, 113, 125, 128, 139
See application file for complete search history.

(56) References Cited

U.S. PATENT DOCUMENTS 3,656,005 A * 4/1972 Lee ..... 200/47
4,331,846 A * 5/1982 Robinson ..... 200/47
4,879,440 A * 11/1989 Lymburner ..... 200/82 R
5,208,483 A * 5/1993 Reneau ..... 307/10.1

* cited by examiner

*Primary Examiner*—Renee Luebke
*Assistant Examiner*—Marina Fishman
(74) *Attorney, Agent, or Firm*—Banger Shia

(57) ABSTRACT

A limit switch control device comprises a shaft, a sensor, an upper limit reed switch, a lower limit reed switch and a drive element that cooperate with a control circuit. The sensor is combined on the shaft which is driven by the drive element, which is provided with an upper limit witch and a lower limit switch, so that when the sensor detects the upper limit and the lower limit reed switches, the upper and the lower limit switches will be triggered to power off the drive element.

6 Claims, 8 Drawing Sheets

LIMIT SWITCH CONTROL DEVICE

BACKGROUND OF THE INVENTION

1. Field of the Invention

The present invention relates to a limit control switch, and more particularly to a limit switch control device.

2. Description of the Prior Art

Common limit switch control devices mainly comprise the following two types:

As shown in FIG. 7, one type of the common limit switch control device is provided with a moving space 10 where a mover 11 is arranged. The mover 11 is combined on a shaft 12 which is driven by a drive element 13. The moving space 10 is interiorly provided a lower limit switch 14 at one end thereof and an upper limit switch 15 at the other end thereof. The lower limit switch 14 and the upper limit switch 15 are directly connected to the drive element 13. When the drive element 13 drives the shaft 12 to move, the mover 11 can be synchronously moved. After the mover 11 which is moving forwards contacts the upper limit switch 15, the upper limit switch 15 will stop the drive element 13 from driving the mover 11 to move forwards while allowing the mover 11 to move backwards. Otherwise, after the mover 11 which is moving backwards contacts the lower limit switch 14, the lower limit switch 14 will stop the drive element 13 from driving the mover 11 to move backwards while allowing the mover 11 to move forwards. However, this limit switch control device has the following disadvantages:

1. Poor practicality: due to the manner in which the lower limit switch 14 and the upper limit switch 15 are arranged in the moving space 10, the positions where the lower limit switch 14 and the upper limit switch 15 cannot be changed. Therefore, the travel distance of the mover 11 cannot be adjusted as desired;

2. High structure damage rate: the electric current directly flows through the lower limit switch 14 and the upper limit switch 15, so it is likely to cause damage to the contacts of the lower limit switch 14 and the upper limit switch 15, thus causing high structure damage rate;

3. Short service life: because the mover 11 directly contacts the lower limit switch 14 and the upper limit switch 15, after a long time of use, it is possible to cause the structural damage to the lower limit switch 14 and the upper limit switch 15, thus shortening the structure service life.

As shown in FIG. 8, the other type of the common limit switch control device is provided with a sensor 22 combined on a shaft 21 in a combining tube 20. The shaft 21 is driven by a drive element 23, and the sensor 22 moves with the shaft 21. A lower limit reed switch 24 and an upper limit reed switch 25 are mounted on the combining tube 20. The two limit reed switches 24, 25 can be controlled to move on the combining tube 20, so as to be selectively fixed at any two positions. This limit switch control device is further used together with a control unit 30 including a drive element control circuit 31 and a limit switch control circuit 32. The drive element control circuit 31 is connected to the drive element 23, and the limit switch control circuit 32 is connected to the two limit reed switches 24, 25.

When the drive element 23 drives the shaft 21 to move in the combining tube 20, the sensor 22 is synchronously moved with the shaft 21. Upon reaching the position where the upper limit reed switch 25 is located, the sensor 22 will send the corresponding signal to the drive element control circuit 31 though the limit switch control circuit 32. After that, the drive element control circuit 31 will make the drive element 23 stop driving the shaft to move forward but enable it to have the ability of controlling the shaft 21 to move backwards, otherwise, on the analogy of this. The travel distance of the shaft 21 can be adjusted by moving the lower limit reed switch 24 and the upper limit reed switch 25 on the combining tube 20. However, this limit switch control device has the following disadvantages:

1. Complex installation: the lower limit reed switch 24 and the upper limit reed switch 25 are exteriorly connected to the control unit 30, and the drive element is also exteriorly connected to the control unit 30, so that a lot of wires are required for installation, thus increasing the installation complexity;

2. High cost: the drive element 23 and the shaft 21are controlled by the lower limit reed switch 24 and the upper limit reed switch 25 through the external control unit 30, which is an additional installation having the disadvantage of high cost.

The present invention has arisen to mitigate and/or obviate the afore-described disadvantages.

SUMMARY OF THE INVENTION

The present invention relates to a limit switch control device which is provided with a movable shaft in a combining tube driven by a drive element. An upper reed switch and a lower limit reed switch are mounted on the combining tube, and a control circuit is provided between the drive element, the upper limit reed switch and the lower limit reed switch. The control circuit includes:

a first power source contact is connected to one electrode of the drive element and connected to a power source; a second power source contact is connected to the power source; a relay includes a first relay contact, a second relay contact, a third relay contact, a fourth relay contact and a fifth relay contact, the first relay contact of the relay is provided with a first diode connected to the first power source contact and a second diode connected to the second power source contact, the third relay contact of the relay is connected to the other electrode of the drive element, the fifth relay contact of the relay is connected to the second power source contact, the first relay contact and the second relay contact of the relay are electrified to generate a magnetic field, the third relay contact and the fifth relay contact of the relay are normally connected with each other; an upper limit switch is arranged correspondingly to the upper limit reed switch and maintained in a normal close state, one end of the upper limit switch is connected to the first power source contact, and the other end of the upper limit switch is connected to the second relay contact of the relay, and between the upper limit switch and the first power source contact are provided a third diode and a second resistor; and a lower limit switch is arranged correspondingly to the lower limit reed switch and maintained in a normal open state, one end of the lower limit switch is connected to the second power source contact, and the other end of the lower limit switch is connected to the second relay contact of the relay, and between the lower limit switch and the second power source contact are provided a fourth diode and a third resistor.

As compared with the functions of the prior art, the present invention has the following advantages:

1. High practicality: in the limit switch control device of the present invention, the upper limit reed switch and the lower limit reed switch are movably arranged, so that the travel distance of the shaft can be adjusted as desired.

2. Reduction of structure damage rate and extension of service life: in the limit switch control device of the present invention, the upper limit reed switch and the lower limit reed switch cooperate with the sensor by means of magnetic induction, so that there is no direct structure contact, thus reducing the structure damage rate and extending the product service life;

3. Simplifying installation: in the limit switch control device of the present invention, the upper limit reed switch, the lower limit reed switch and the control element are interrelated and interact on each other through the control circuit which is directly integrated on the limit switch control device without any additional connection, thus greatly reducing the required amount of the electrical wires and consequentially simplifying the installation;

4. Lowering cost: in the limit switch control device of the present invention, the upper limit reed switch, the lower limit reed switch and the control element utilize the control circuit which is directly integrated on the limit switch control device to realize the predetermined action and function, thus greatly reducing the manufacturing cost;

5. Improving operation accuracy: in the limit switch control device of the present invention, the upper limit reed switch, the control circuit can utilize the fourth relay contact provided with a resistor and connected to the positive electrode of power source to excite the relay to generate a magnetic field, so as to stop the drive element and synchronously connect both electrodes of the drive element to the same positive electrode, thus avoiding the inertia operation of the drive element and consequentially improving the operation accuracy.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
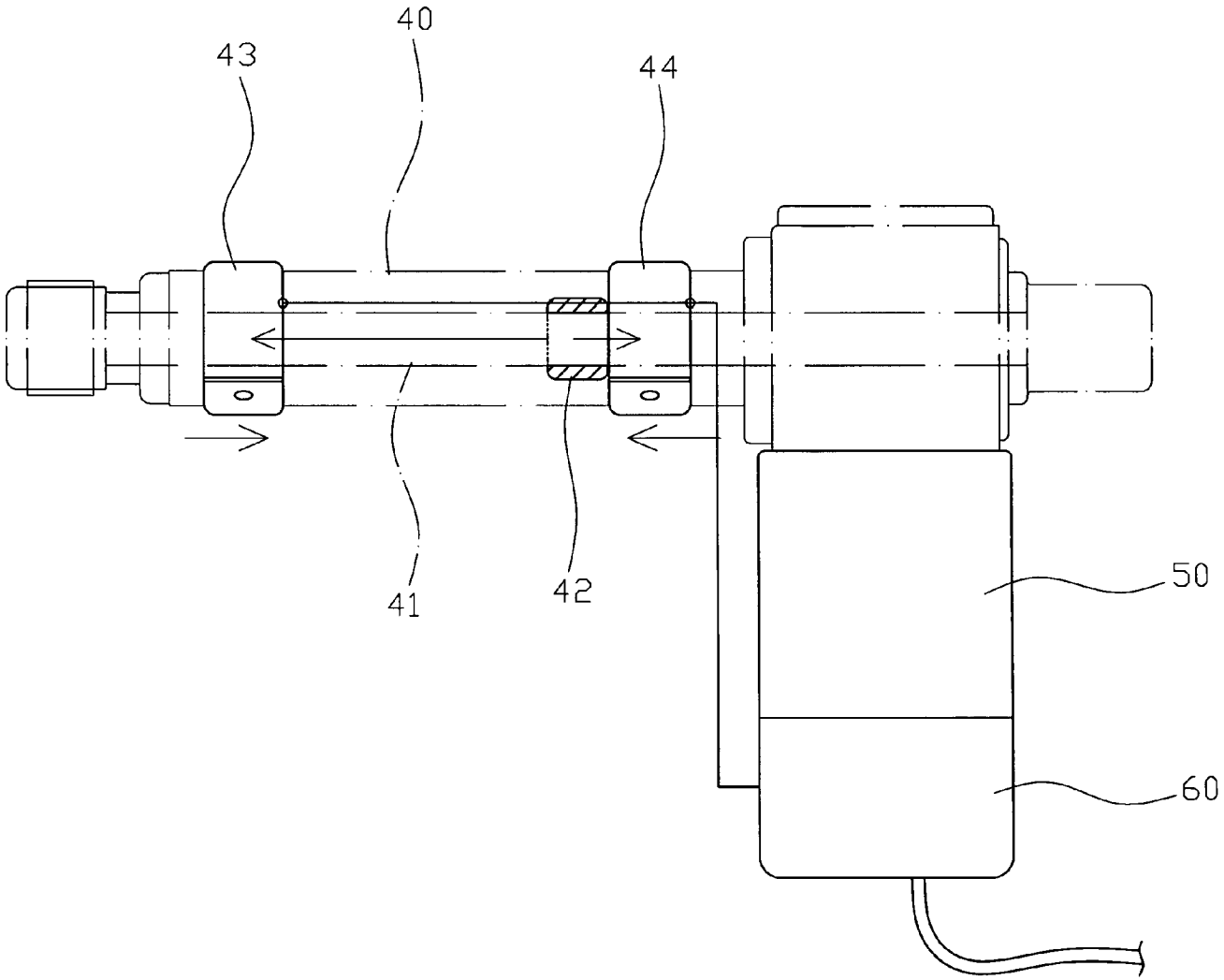
FIG. 1 is a structural view of a limit switch control device in accordance with the present invention.
Figure 2:
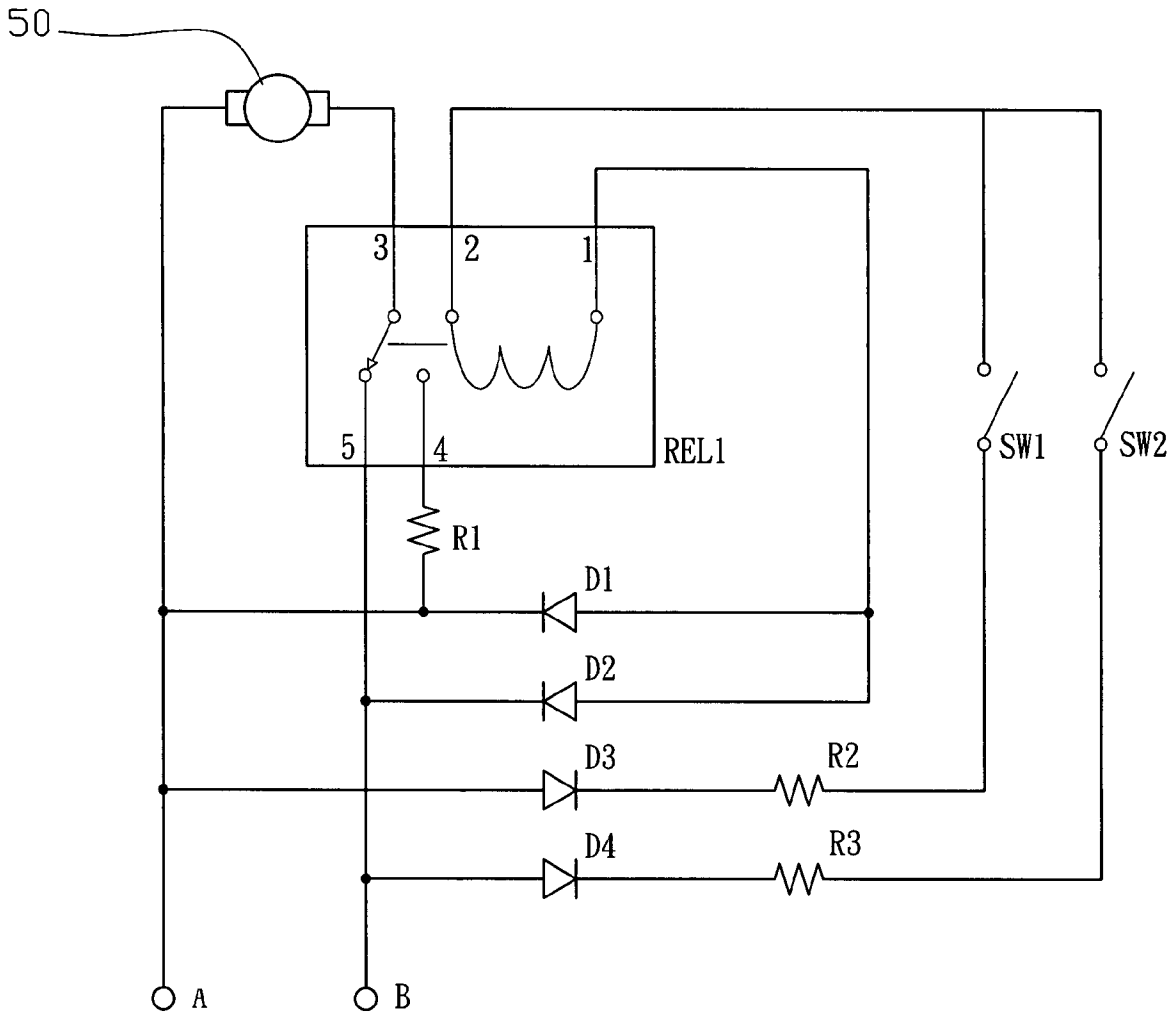
FIG. 2 is a circuit diagram of a control circuit in accordance with the present invention.

Referring to FIGS. 1-2 first, a limit switch control device in accordance with the present invention comprises a combining tube 40, a drive element 50 and a control circuit 60.

The combining tube 40 is interiorly provided with a movable shaft 41 which is combined with a sensor 42 and driven by the drive element 50. An upper limit reed switch 43 and a lower limit reed switch 44 are separately mounted on the combining tube 40 and can be moved and then fixed on the combining tube 40. The control circuit 60 is cooperatively arranged between the upper limit reed switch 43 and the lower limit reed switch 44.

The drive element 50 is a DC (direct current) brush or brushless motor.

The control circuit 60 includes a first power source contact A, a second power source contact B, a relay REL1, an upper limit switch SW1, a lower limit switch SW2.

The first power source contact A is directly connected to one electrode of the drive element 50 and connected to the power source.

The second power source B cooperates with the first power source A to connect with the power source. The first power source contact A and the second power source contact B are connected to the positive and negative electrodes of the power source, respectively.

The relay REL1 includes a first relay contact 1, a second relay contact 2, a third relay contact 3, a fourth contact 4 and a fifth relay contact 5. The first relay contact 1 is provided with a first diode D1 connected to the first power source contact A and a second diode D2 connected to the second power source contact B. The third relay contact 3 is connected to the other electrode of the drive element 50. The fourth relay contact 4 is provided with a first resistor R1 connected to the first power source contact A. The fifth relay contact 5 is connected to the second power source contact B. The first relay contact 1 and the second relay contact 2 are electrified to excite a magnetic field. The third relay contact 3 and the fifth contact 5 are normally connected with each other.

The upper limit switch SW1 is arranged correspondingly to the upper limit reed switch 43 and normally maintained in an open state. One end of the upper limit switch SW1 is connected to the first power source contact A, and the other end of the upper limit switch SW1 is connected to the second relay contact 2 of the relay REL1. Between the upper limit switch SW1 and the first power source contact A are provided a third diode D3 and a second resistor R2.

The lower limit switch SW2 is arranged correspondingly to lower limit reed switch 44 and normally maintained in an open state. One end of the lower limit switch SW2 is connected to the second power source contact B, and the other end of the lower limit switch SW2 is connected to the second relay contact 2 of the relay REL1. Between the lower limit switch SW2 and the second power source contact B are provided a fourth diode D4 and a third resistor R3.

Figure 3:
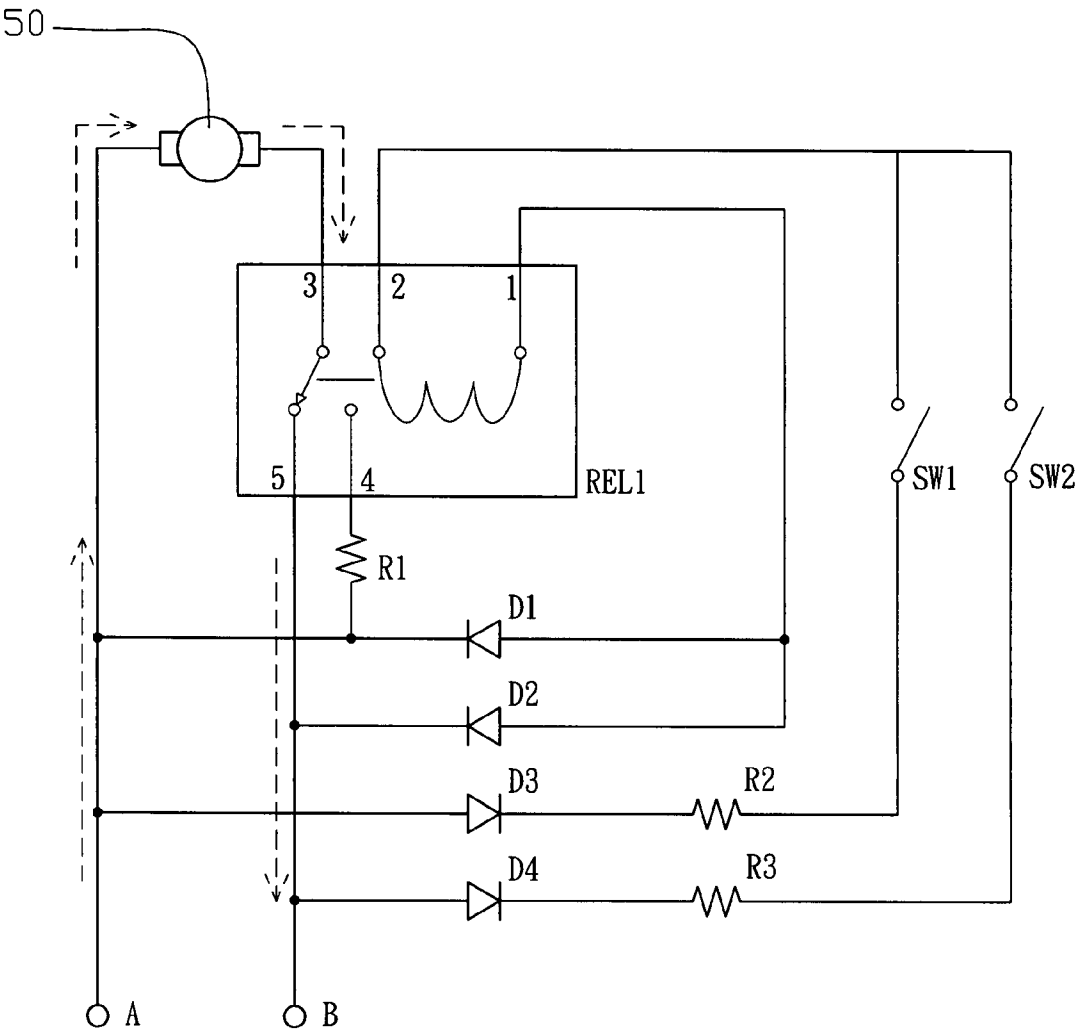
FIG. 3 is a circuit diagram illustrating a power-on state of the control circuit in accordance with the present invention.
Figure 4:
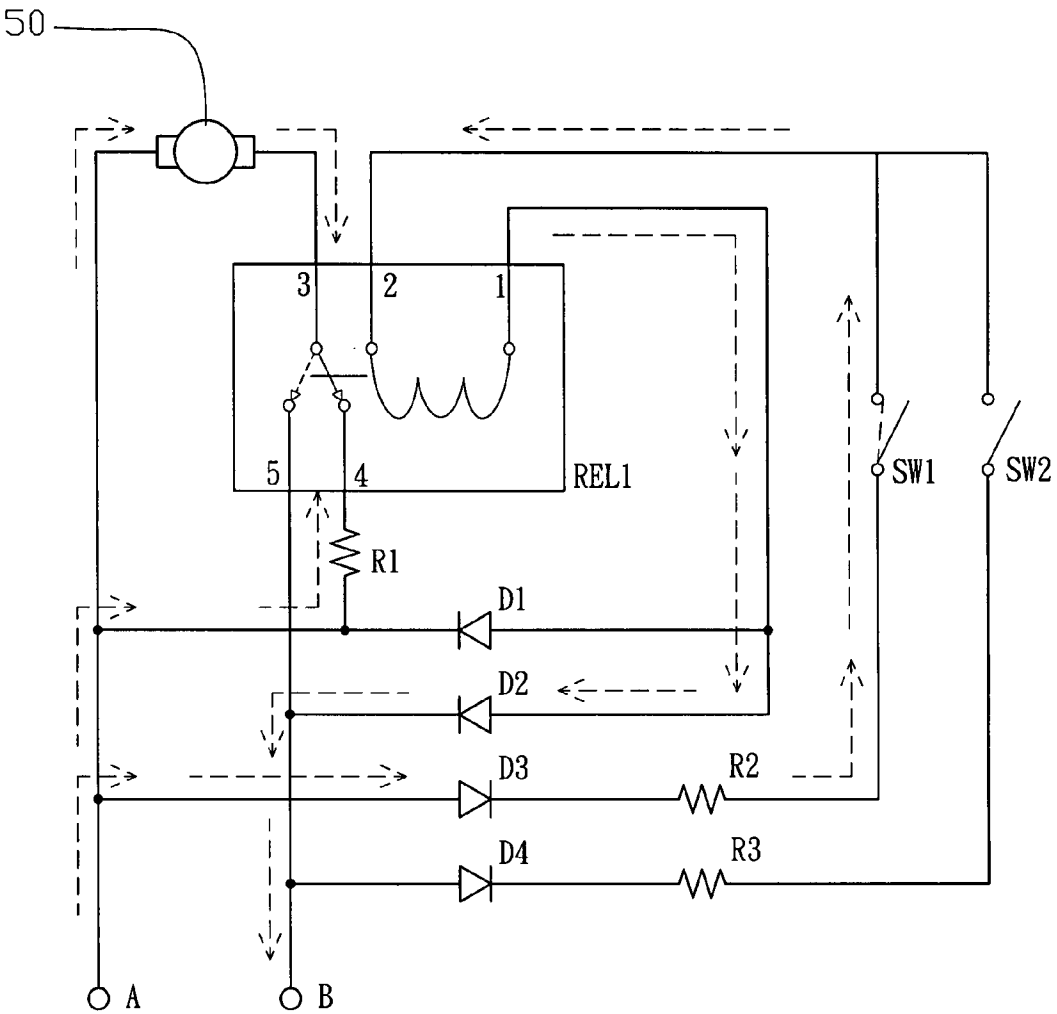
FIG. 4 is a circuit diagram illustrating a power-off state of the upper limit switch of the control circuit in accordance with the present invention.
Figure 5:
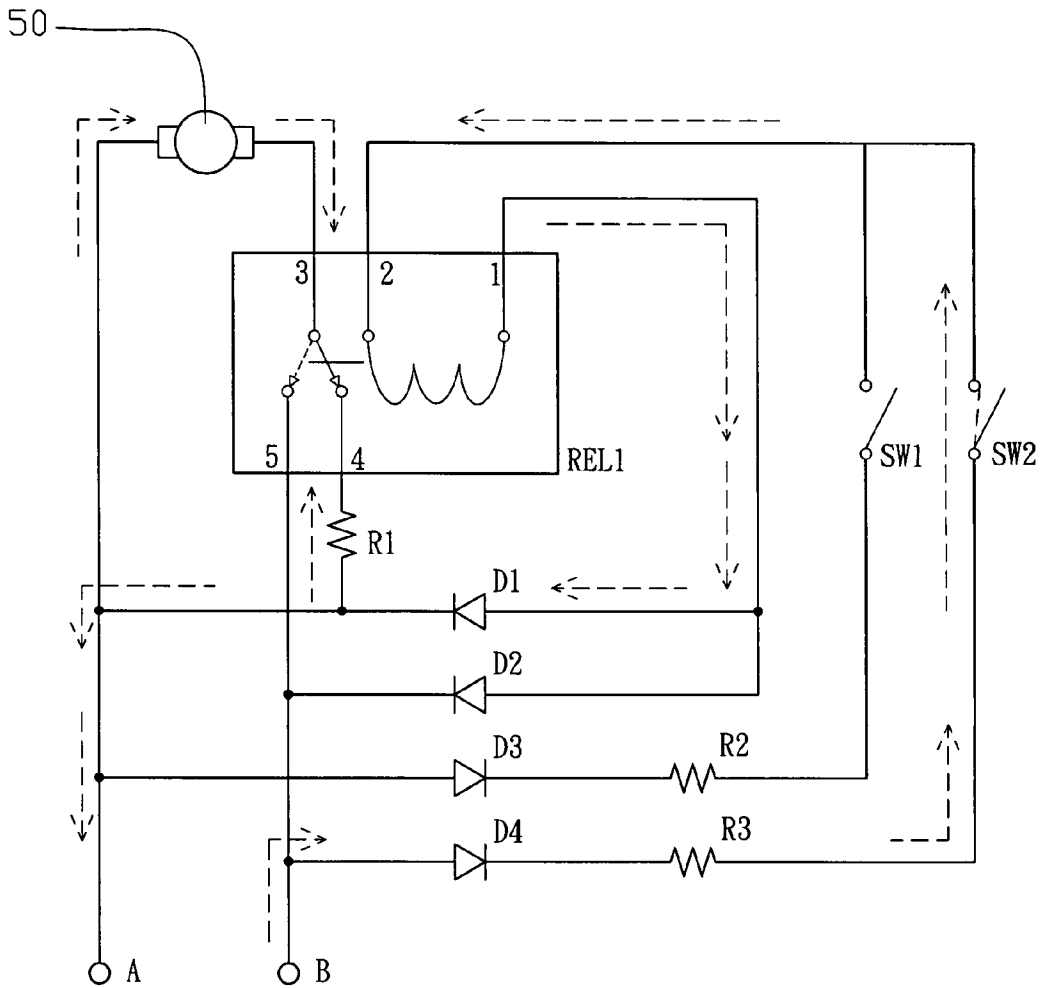
FIG. 5 is a circuit diagram illustrating a power-off state of the lower limit switch of the control circuit in accordance with the present invention.

Referring to FIG. 3, after the first power source contact A and the second power source contact B of the control circuit 60 are electrified, one electrode of the drive element 50 will be connected to the first power source contact A and the positive electrode of the power source, the second power source contact B and the negative electrode of the power source will be connected to the third relay contact 3 via the fifth relay contact 5 and then connected to the other electrode of the drive element 50, so that the drive element 50 will be electrified to operate and drive the shaft 41 and the sensor 42 to move. As shown in FIG. 4, when the shaft 41 and the sensor 42 reaches a position where the upper limit switch is located, the upper limit reed switch 43 will be sensed. At this moment, the upper limit switch SW1 is closed, so that the positive electrode of the first power source contact A is connected to the second relay contact 2 of the relay REL1 via the third diode D3 and the second resistor R2, and the first relay contact 1 of the relay REL1 is connected to the negative electrode of the second power source contact B via the second diode D2, so as to excite the relay REL1 to generate a magnetic field for disconnecting the third relay contact 3 from the fifth relay contact 5 and connecting the third relay contact 3 to the fourth relay contact 4. Therefore, the drive element 50 is powered off and stops working. At this moment, the shaft 41 stops moving forward, and the third relay contact 3 is connected to the fourth relay contact 4 and then connected to the positive electrode of the first power source contact A via the first resistor R1 in such a manner that both electrodes of the drive element 50 are connected to the positive electrode of the power source, thus instantaneously ceasing the inertia operation of the drive element 50. After the first power source contact A and the second power source contact B are powered off, the third relay contact 3 of the relay REL1 will be reconnected to the fifth relay contact 5. Subsequently, referring to FIG. 5, when the first power source contact A is connected to the negative electrode of the power source and the second power source contact B is connected to the positive electrode of the power source, the drive element 50 will drive the shaft 41 to move reversely, and then, when the sensor 42 reaches the position where the lower limit reed switch 44 is located, the lower limit reed switch 44 will be sensed. At this moment, the lower limit switch SW2 will be closed to connect the second power source B and the positive electrode of the power source to the second relay contact 2 of the relay REL1 via the fourth diode D4 and the third resistor R3, and the first relay contact 1 of the relay REL1 will be connected to the first power source contact A and the negative electrode of the power source via the second diode D2 to excite the relay REL1 to generate a magnetic field for disconnecting the third relay contact 3 from the fifth contact 5 and connecting the third relay contact 3 to the fourth relay contact 4. Therefore, the drive element 50 is powered off to stop working, and the third relay contact 3 is connected to the fourth relay contact 4 and then connected to the negative electrode of the first power source contact A via the first resistor R1 in such a manner that both electrodes of the control component are connected to the negative electrode of the power source, thus instantaneously ceasing the inertia operation of the drive element 50.

Figure 6:
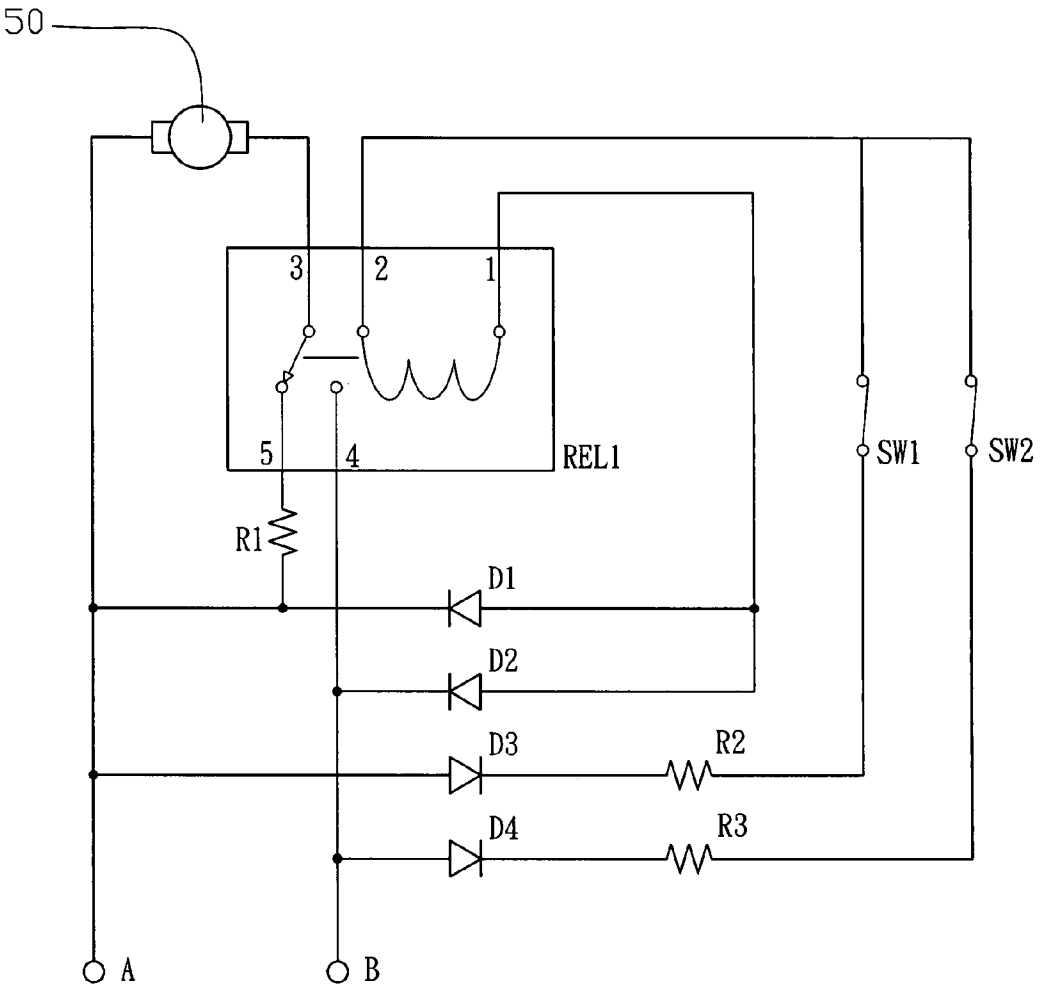
FIG. 6 is a circuit diagram of another control circuit in accordance with the present invention.
Figure 7:
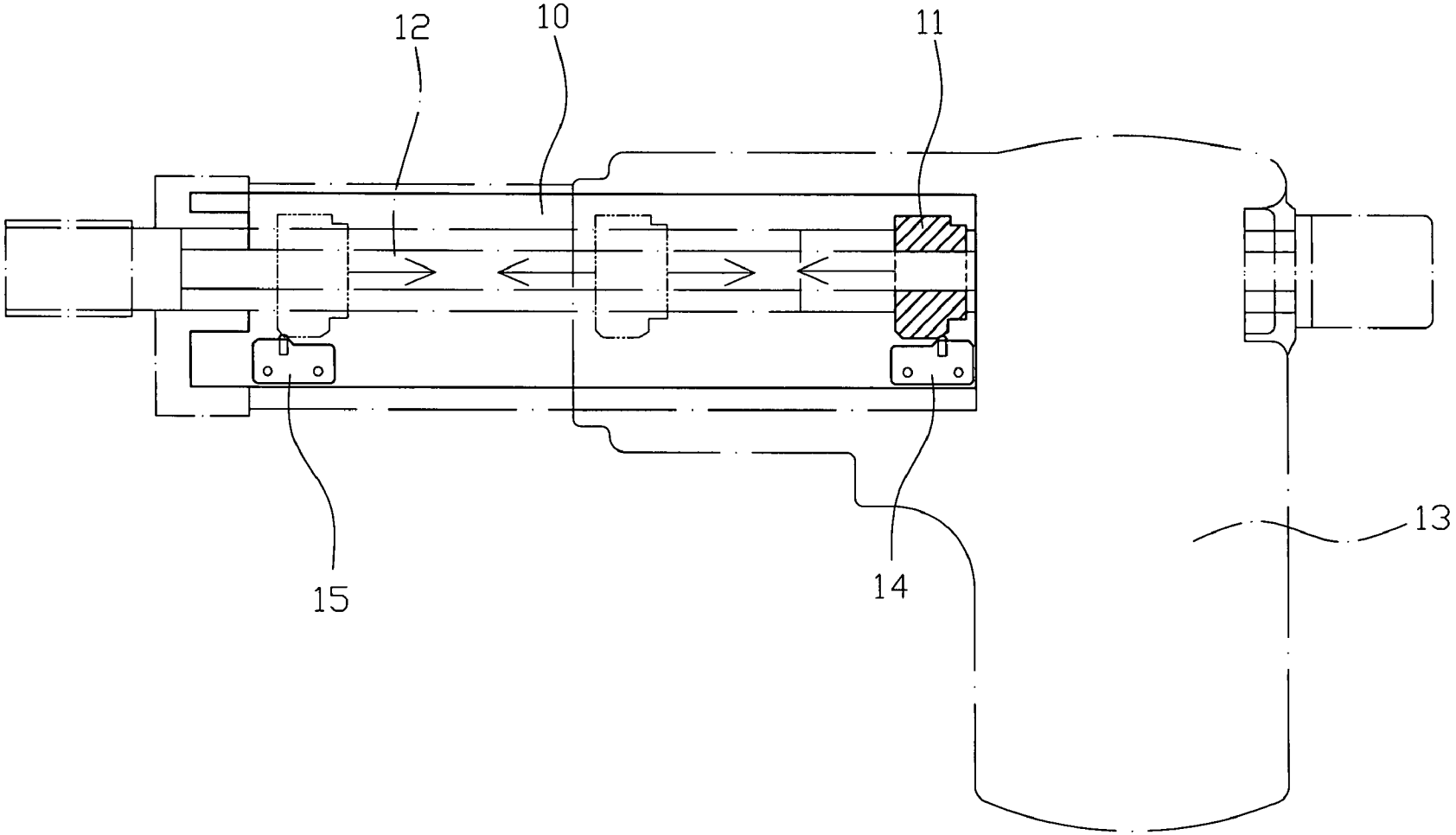
FIG. 7 PRIOR ART
FIG. 7 is a structural view of a conventional limit switch control device.
Figure 8:
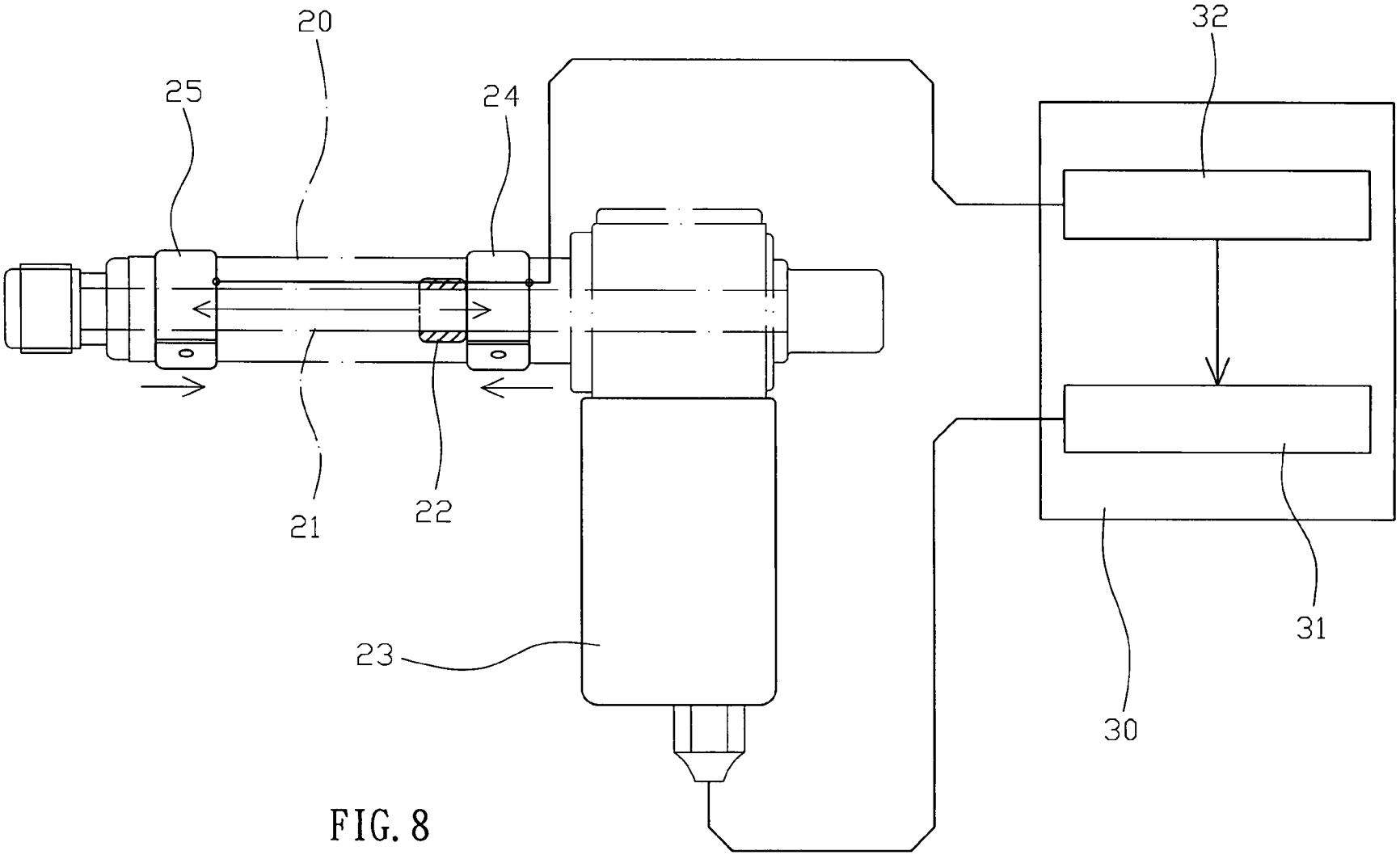
FIG. 8 PRIOR ART
FIG. 8 is a structural view of another conventional limit switch control device.

FIG. 6 illustrates a limit switch control device in accordance with another embodiment of the present invention, which has an equivalent functionality. In the present embodiment, the upper limit switch SW1 and the lower limit switch SW2 are also set in a normal close state, the fourth relay contact 4 of the REL1 is connected to the second power source contact B, and the fifth relay contact 5 and the first resistor R1 are connected to the first power source A.

As known from the above embodiments of the present invention, the present invention has the following advantages:

1. High practicality: the upper limit reed switch 43 and the lower limit reed switch 44 of the limit switch control device of the present invention are movable, so that the travel distance of the shaft 41 can be adjusted as desired;

2. Long service life: in the limit switch control device of the present invention, the upper limit reed switch 43 and the lower limit reed switch 44 cooperate with the sensor 42 to actuate the upper limit switch SW1 and the lower limit switch SW2 by means of magnetic induction without any direct contact therebetween, thus reducing the structure damage rate and consequentially extending the product service life;

3. Simplifying installation: the upper limit reed switch 43, the lower limit reed switch 44 and the drive element 50 are interrelated and interact on each other through the control circuit 60 which can be integrally formed on the limit switch control device of the present invention without any additional connection, thus simplifying installation;

4. Lower cost: the upper limit reed switch 43, the lower limit reed switch 44 and the drive element 50 utilizes the control circuit 60 which is integrally formed on the limit switch control device of the present invention to realize the predetermined action and function, thus reducing cost and increasing industrial competitiveness;

5. High operation accuracy: in the control circuit 60 of the present invention, the fourth relay contact 4 of the relay REL1 is provided with a first resistor R and connected to the first power source contact A or the second power source contact B to excite the relay REL1 to generate a magnetic field, so that when the drive 50 stops working, both electrodes of the drive element 50 are connected to the positive electrode or the negative electrode of the power source, so that the drive element 50 and the shaft 41 can be instantaneously stopped, thus avoiding the inertia operation of the drive element and increasing the operation accuracy.

While we have shown and described various embodiments in accordance with the present invention, it is clear to those skilled in the art that further embodiments may be made without departing from the scope of the present invention.

What is claimed is:

1. A limit switch control device comprising a shaft, a sensor, an upper limit reed switch, a lower limit reed switch and a drive element that cooperate with a control circuit, wherein the sensor is combined on the shaft which is driven by the drive element, the upper limit reed switch and the lower limit reed switch are arranged according to a travel path of the shaft, the limit switch control device is characterized in that:

the control circuit includes:

a first power source contact is connected to one electrode of the drive element and connected to a power source;

a second power source contact is connected to the power source, the first power source contact and the second power source contact are connected to a positive electrode and a negative electrode of the power source, respectively;

a relay includes a first relay contact, a second relay contact, a third relay contact, a fourth relay contact and a fifth relay contact, the first relay contact of the relay is provided with a first diode connected to the first power source contact and a second diode connected to the second power source contact, the third relay contact of the relay is connected to the other electrode of the drive element, the fifth relay contact of the relay is connected to the second power source contact, the first relay contact and the second relay contact of the relay are electrified to generate a magnetic field, the third relay contact and the fifth relay contact of the relay are normally connected with each other;

an upper limit switch is arranged correspondingly to the upper limit reed switch and maintained in a normal open state, one end of the upper limit switch is connected to the first power source contact, and the other end of the upper limit switch is connected to the second relay contact of the relay, and between the upper limit switch and the first power source contact are provided a third diode and a second resistor; and a lower limit switch is arranged correspondingly to the lower limit reed switch and maintained in a normal close state, one end of the lower limit switch is connected to the second power source contact, and the other end of the lower limit switch is connected to the second relay contact of the relay, and between the lower limit switch and the second power source contact are provided a fourth diode and a third resistor.

2. The limit switch control device as claimed in claim 1, wherein the drive element is a direct current element.

3. The limit switch control device as claimed in claim 1, wherein the fourth relay contact is connected to the first power source contact via a first resistor.

4. A limit switch control device comprising: a shaft, a sensor, an upper limit reed switch, a lower limit reed switch and a drive element that cooperate with a control circuit, wherein the sensor is combined on the shaft which is driven by the drive element, the upper limit reed switch and the lower limit reed switch are arranged according to a travel path of the shaft, the limit switch control device is characterized in that:

the control circuit includes:

a first power source contact is connected to one electrode of the drive element and connected to a power source;

a second power source contact is connected to the power source, the first power source contact and the second power source contact are connected to a positive electrode and a negative electrode of the power source, respectively;

a relay includes a first relay contact, a second relay contact, a third relay contact, a fourth relay contact and a fifth relay contact, the first relay contact of the relay is provided with a first diode connected to the first power source contact and a second diode connected to the second power source contact, the third relay contact of the relay is connected to the other electrode of the drive element, the fourth relay contact of the relay is connected to the second power source contact, the first relay contact and the second relay contact of the relay are electrified to generate a magnetic field, the third relay contact and the fifth relay contact of the relay are normally connected with each other;

an upper limit switch is arranged correspondingly to the upper limit reed switch and maintained in a normal close state, one end of the upper limit switch is connected to the first power source contact, and the other end of the upper limit switch is connected to the second relay contact of the relay, and between the upper limit switch and the first power source contact are provided a third diode and a second resistor; and a lower limit switch is correspondingly to the lower limit reed switch and maintained in a normal open state, one end of the lower limit switch is connected to the second power source contact, and the other end of the lower limit switch is connected to the second relay contact of the relay, and between the lower limit switch and the second power source contact are provided a fourth diode and a third resistor.

5. The limit switch control device as claimed in claim 4, wherein the drive element is a direct current element.

6. The limit switch control device as claimed in claim 4, wherein the fifth relay contact is connected to the first power source contact via a first resistor.

* * * * *